US006989803B2

(12) United States Patent
Tokunaga et al.

(10) Patent No.: US 6,989,803 B2
(45) Date of Patent: Jan. 24, 2006

(54) PLASMA DISPLAY PANEL DRIVING METHOD

(75) Inventors: Tsutomu Tokunaga, Yamanashi (JP); Mitsunori Taguchi, Yamanashi (JP)

(73) Assignees: Pioneer Corporation, Tokyo (JP); Shizuoka Pioneer Corporation, Shizuoka (JP)

( * ) Notice: Subject to any disclaimer, the term of this patent is extended or adjusted under 35 U.S.C. 154(b) by 261 days.

(21) Appl. No.: 10/163,602

(22) Filed: Jun. 7, 2002

(65) Prior Publication Data

US 2003/0011541 A1 Jan. 16, 2003

(30) Foreign Application Priority Data

Jun. 20, 2001 (JP) ..... 2001-186461

(51) Int. Cl.
*G09G 3/28* (2006.01)

(52) U.S. Cl. ..... 345/63; 345/60

(58) Field of Classification Search ..... 345/60–68
See application file for complete search history.

(56) References Cited

U.S. PATENT DOCUMENTS 6,642,912 B2 * 11/2003 Furutani ..... 345/68
2002/0054001 A1 * 5/2002 Awamoto ..... 345/60

* cited by examiner

*Primary Examiner*—Regina Liang
*Assistant Examiner*—Duc Q Dinh
(74) *Attorney, Agent, or Firm*—Sughrue Mion, PLLC

(57) ABSTRACT

A method of driving a plasma display panel minimizes occurrence of complementary color ghost images (afterimage). Reset pulses are applied to a plurality of row electrode pairs to trigger a reset discharge in all discharge cells. The reset pulses include a first reset pulse that is applied to one of the row electrodes of each row electrode pair and a second reset pulse that is applied to the other row electrode at the same time that the first reset pulse is applied and has a polarity opposite that of the first reset pulse. The first and second reset pulses have different voltage levels.

3 Claims, 11 Drawing Sheets

FIG. 6

| DS | HD | | | | | | | | | | | | | | LIGHT EMISSION DRIVING PATTERN FOR ONE FIELD | | | | | | | | | | | | | | LIGHT INTENSITY (LUMINANCE) |
|---|---|---|---|---|---|---|---|---|---|---|---|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | SF 1 | SF 2 | SF 3 | SF 4 | SF 5 | SF 6 | SF 7 | SF 8 | SF 9 | SF 10 | SF 11 | SF 12 | SF 13 | SF 14 | |
| 0000 | 1 | 0 | 0 | 0 | 0 | 0 | 0 | 0 | 0 | 0 | 0 | 0 | 0 | 0 | ● | | | | | | | | | | | | | | 0 |
| 0001 | 0 | 1 | 0 | 0 | 0 | 0 | 0 | 0 | 0 | 0 | 0 | 0 | 0 | 0 | ○ | ● | | | | | | | | | | | | | 1 |
| 0010 | 0 | 0 | 1 | 0 | 0 | 0 | 0 | 0 | 0 | 0 | 0 | 0 | 0 | 0 | ○ | ○ | ● | | | | | | | | | | | | 4 |
| 0011 | 0 | 0 | 0 | 1 | 0 | 0 | 0 | 0 | 0 | 0 | 0 | 0 | 0 | 0 | ○ | ○ | ○ | ● | | | | | | | | | | | 9 |
| 0100 | 0 | 0 | 0 | 0 | 1 | 0 | 0 | 0 | 0 | 0 | 0 | 0 | 0 | 0 | ○ | ○ | ○ | ○ | ● | | | | | | | | | | 17 |
| 0101 | 0 | 0 | 0 | 0 | 0 | 1 | 0 | 0 | 0 | 0 | 0 | 0 | 0 | 0 | ○ | ○ | ○ | ○ | ○ | ● | | | | | | | | | 27 |
| 0110 | 0 | 0 | 0 | 0 | 0 | 0 | 1 | 0 | 0 | 0 | 0 | 0 | 0 | 0 | ○ | ○ | ○ | ○ | ○ | ○ | ● | | | | | | | | 40 |
| 0111 | 0 | 0 | 0 | 0 | 0 | 0 | 0 | 1 | 0 | 0 | 0 | 0 | 0 | 0 | ○ | ○ | ○ | ○ | ○ | ○ | ○ | ● | | | | | | | 56 |
| 1000 | 0 | 0 | 0 | 0 | 0 | 0 | 0 | 0 | 1 | 0 | 0 | 0 | 0 | 0 | ○ | ○ | ○ | ○ | ○ | ○ | ○ | ○ | ● | | | | | | 75 |
| 1001 | 0 | 0 | 0 | 0 | 0 | 0 | 0 | 0 | 0 | 1 | 0 | 0 | 0 | 0 | ○ | ○ | ○ | ○ | ○ | ○ | ○ | ○ | ○ | ● | | | | | 97 |
| 1010 | 0 | 0 | 0 | 0 | 0 | 0 | 0 | 0 | 0 | 0 | 1 | 0 | 0 | 0 | ○ | ○ | ○ | ○ | ○ | ○ | ○ | ○ | ○ | ○ | ● | | | | 122 |
| 1011 | 0 | 0 | 0 | 0 | 0 | 0 | 0 | 0 | 0 | 0 | 0 | 1 | 0 | 0 | ○ | ○ | ○ | ○ | ○ | ○ | ○ | ○ | ○ | ○ | ○ | ● | | | 150 |
| 1100 | 0 | 0 | 0 | 0 | 0 | 0 | 0 | 0 | 0 | 0 | 0 | 0 | 1 | 0 | ○ | ○ | ○ | ○ | ○ | ○ | ○ | ○ | ○ | ○ | ○ | ○ | ● | | 182 |
| 1101 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | 217 |
| 1110 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | 255 |

BLACK CIRCLES : SELECTIVE ERASING DISCHARGE
WHITE CIRCLES : LIGHT EMISSION

NON-LIGHT EMITTING PIXEL CELL (G, B CELL)

LIGHT EMITTING PIXEL CELL (R CELL)

IMMEDIATELY AFTER PIXEL DATA WRITING

AFTER LIGHT EMISSION SUSTAINING OPERATION COMPLETED

PLASMA DISPLAY PANEL DRIVING METHOD

BACKGROUND OF THE INVENTION

1. Field of the Invention

The present invention pertains to a method for driving a plasma display panel (hereinafter referred to as 'PDP').

2. Description of the Related Art

As one type of PDPs operated on a matrix display method, a discharge-type alternating current PDP has been put to practical use, and various constructions and driving methods have been proposed therefor.

A discharge-type alternating current PDP includes a plurality of column electrodes (address electrodes) and a plurality of row electrode pairs that extend perpendicular to these column electrodes. Each of the row electrode pairs forms one display line. The row electrode pairs and column electrodes are covered by a dielectric layer and are separated from the discharge space. A discharge cell is formed at an intersection of each pair of row electrodes and each column electrode. These discharge cells are infused with a discharge gas such as xenon (Xe).

In order to display a color image, each pixel of the PDP emits light in the three primary colors of R (red), G (green) and B (blue). Specifically, as illustrated in FIG. 1 of the accompanying drawings, each pixel P of the PDP includes a red discharge cell CR that emits red light (R), a green discharge cell CG that emits green light (G), and a blue discharge cell CB that emits blue light (B). Each discharge cell has a fluorescent layer that corresponds to the color of the light emitted by that discharge cell.

In order to display an image corresponding to image signals input to the pixels, gradation driving of the PDP is carried out using a sub-field scheme or method. Sub-field methods include the selective erasing address method and the selective writing address method. In the selective erasing address method, a wall charge is formed beforehand in all discharge cells by a reset discharge induced upon simultaneous application of a reset pulse to both row electrodes in each row electrode pair (simultaneous or global reset operation), the wall charge in the discharge cells is selectively erased in accordance with input image signals (pixel data writing operation), the discharge cells are caused to emit light in accordance with the wall charge remaining in the discharge cells due to a sustaining discharge triggered by the alternating application of sustaining pulses to the row electrodes of the row electrode pair (light emission sustaining operation), and the above operations are repeated. In the selective writing address method, on the other hand, the wall charge is erased in all the discharge cells beforehand by the reset discharge caused upon the simultaneous application of a reset pulse to both row electrodes in each row electrode pair (simultaneous reset operation), a wall charge is formed in selected discharge cells in accordance with input image signals (pixel data writing operation), the discharge cells are caused to emit light in accordance with the wall charge formed in the discharge cells upon the sustaining discharge triggered by the alternating application of sustaining pulses to the row electrodes of the row electrode pair (light emission sustaining operation), and the above operations are repeated.

In both driving methods, although the pulse voltage (V) of the pulses supplied simultaneously to the two row electrodes of the row electrode pair in the simultaneous reset operation is identical for both pulses, the pulses have different (opposite) polarities. Accordingly, when the difference in electric potential between the row electrodes exceeds the discharge start voltage, electric discharge occurs between the row electrodes.

For example, when 'red' is being displayed by the pixel P, discharge occurs repeatedly between the pair of row electrodes in the red discharge cell CR during the light emission sustaining operation, thereby causing the red color to be emitted (displayed), and the discharge start voltage is maintained at a high level between the address electrode and the row electrodes. However, because no discharge occurs in the green discharge cell CG and the blue discharge cell CB in the same pixel, the discharge start voltage between the address electrode and the row electrodes becomes low.

Therefore, when a reset pulse is applied to the row electrodes in all discharge cells in the subsequent simultaneous reset operation, a discharge may occur between address electrode and row electrodes for the green and blue discharge cells CG and CB because the discharge start voltage between the address electrode and the row electrodes for the green and blue discharge cells CG and CB is low. Because the discharge occurring between the address electrode and the row electrodes for the green and blue discharge cells CG and CB has a higher light intensity than the discharge occurring between the address electrode and the row electrodes for the red discharge cell CR having a higher discharge start voltage, the uniformity among the light emission intensities of the three primary colors in the pixel is destroyed, and a photogene (afterimage, ghost image) of a complementary color appears after 'red' is sometimes perceived (displayed).

When a plurality of reset pulses are applied to the row electrode pairs in the simultaneous reset operation, an amount of wall charge in the vicinity of the address electrode and the row electrodes increases if the first discharge between the address and row electrodes is strong. This triggers a strong discharge between the address and row electrodes upon application of the second and third reset pulses to the row electrode pairs. As a result, the photogene of a complementary color sometimes appears after 'red' is displayed.

The above tendency becomes particularly significant when display is alternated from 'red' to 'black'. The tendency for a luminance photogene to appear is marked in a PDP if the discharge gas in the PDP has a high concentration of xenon gas and the discharge start voltage between the address and row electrodes is relatively low in the original setting of the PDP.

SUMMARY OF THE INVENTION

An object of the present invention is to provide a plasma display panel driving method that reduces the amount of discharge light emission during the simultaneous reset operation to weaken the complementary color photogene that appears when a color image has been displayed.

According to one aspect of the present invention, there is provided a method of driving a plasma display panel in accordance with image (video) signals, the plasma display panel including a plurality of row electrode pairs, each of which pairs defines a display line, and a plurality of column electrodes arranged in a perpendicular fashion to the row electrode pairs such that a plurality of discharge cells, which function as display pixels, are formed at respective intersections between the column electrodes and row electrode pairs, with a display period for one field being divided into a plurality of sub-fields, wherein each sub-field is driven by a pixel data writing operation in which a scanning pulse is applied to one row electrode of each row electrode pair and a pixel data pulse corresponding to the image signal is applied to each column electrode for generating a selecting discharge so as to set every discharge cell to either a light emission state or a non-light emission state, and a light emission sustaining operation in which sustaining pulses are applied to the row electrode pair of every discharge cell for triggering a sustaining discharge in only those discharge cells which are set to the light emission state, so as to cause these discharge cells to repeatedly emit light, wherein either a plurality of sub-fields or each sub-field is also driven by a reset operation in which, prior to the pixel data writing operation, reset pulses are applied to the plurality of row electrode pairs to trigger a reset discharge in the discharge cells, and wherein the reset pulses include a first reset pulse applied to the one row electrode of each row electrode pair and a second reset pulse applied to the other row electrode of each row electrode pair at the same time as the first reset pulse is applied, and the second reset pulse has a polarity opposite that of the first reset pulse, and a voltage level different from the first reset pulse.

In a simultaneous reset operation performed when the PDP is driven, the voltage value of the first reset pulse applied to one electrode of the row electrode pair is different from the voltage value of the second reset pulse applied to the other electrode of the row electrode pair. Therefore, the occurrence of a complementary color ghost image (afterimage) after a color image is displayed can be minimized.

BRIEF DESCRIPTION OF THE DRAWINGS

FIG. 6 illustrates a light emission pattern for each of sub-fields that define the field;

FIG. 10A illustrates the state immediately after pixel data writing, and FIG. 10B illustrates the state after completion of the light emission sustaining operation;

DETAILED DESCRIPTION OF THE INVENTION

Embodiments of the present invention are described in detail below with reference to the drawings.

Figure 1:
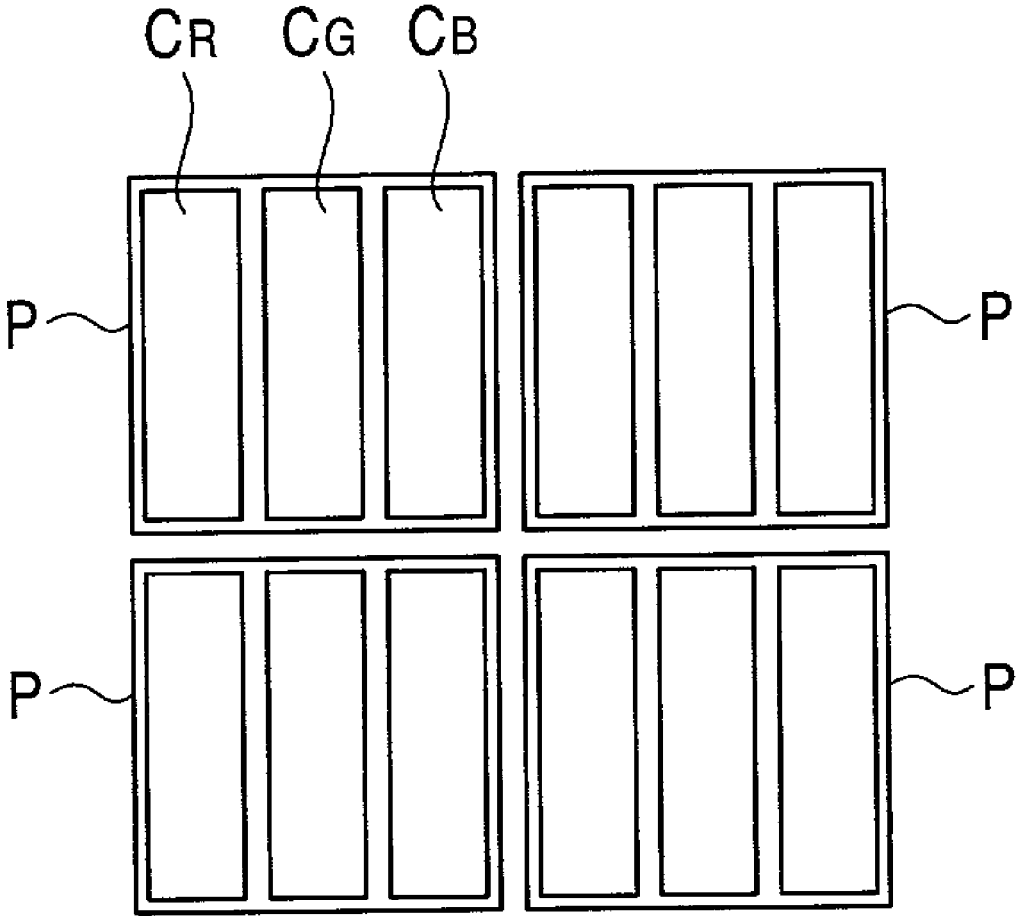
FIG. 1 schematically illustrates the arrangement of red, green and blue discharge cells to display a color in a PDP.
Figure 2:
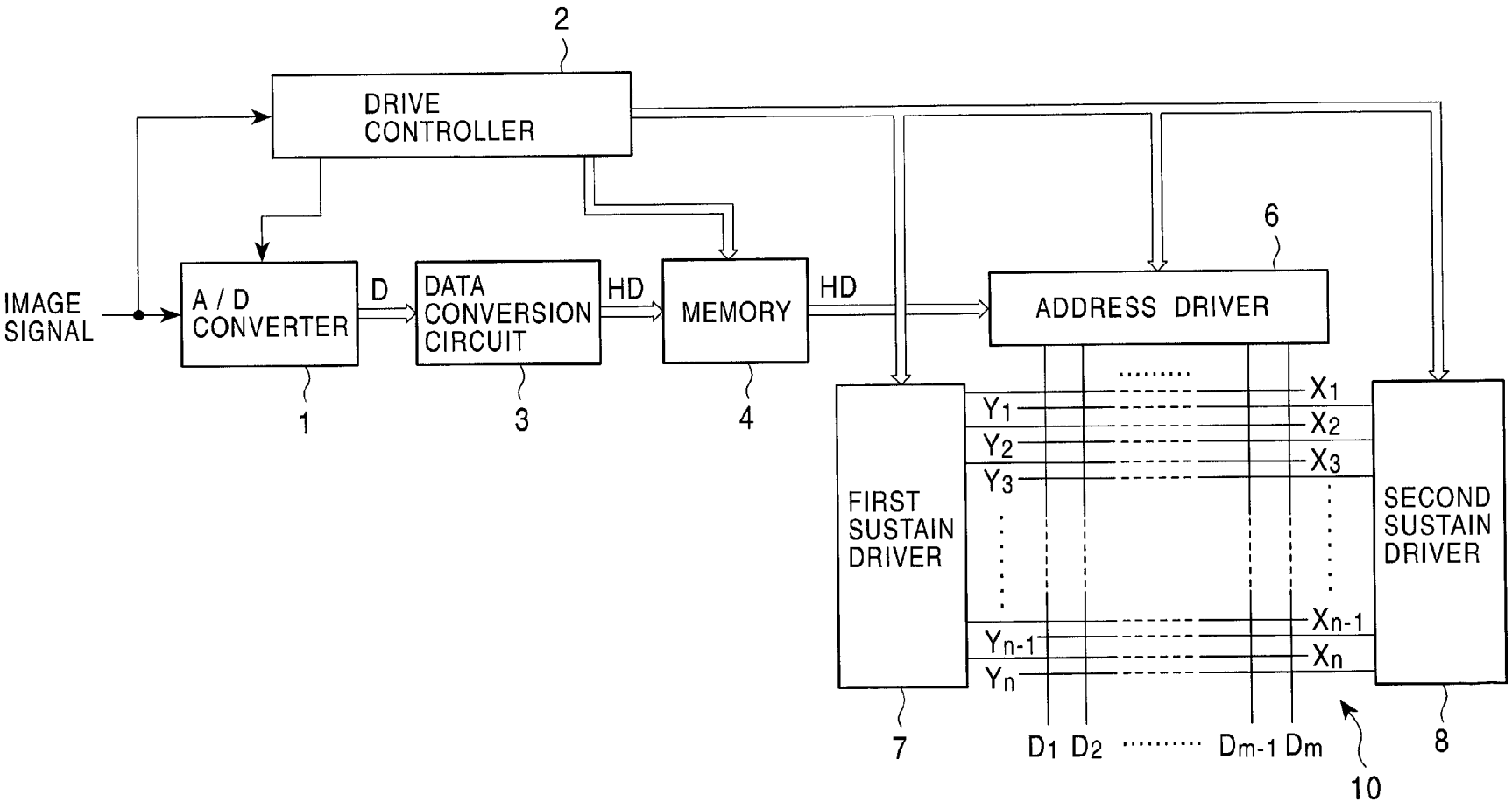
FIG. 2 shows the basic construction of the PDP driven by an embodiment of the driving method according to the present invention.

Referring to FIG. 2, is illustrated the construction of a plasma display device that drives a PDP 10 in accordance with one embodiment of the driving method of the present invention.

In FIG. 2, the plasma display device includes an A/D converter 1, a driving control circuit 2, a data conversion circuit 3, a memory 4, an address driver 6, a first sustain driver 7, a second sustain driver 8, and a PDP 10.

The A/D converter 1 performs sampling of the analog input image signals in accordance with clock signals supplied by the driving control circuit 2 and converts the sampled image signals into, for example, 8-bit pixel data (input pixel data) D for each pixel. The A/D converter 1 then supplies the input pixel data D to the data conversion circuit 3.

The driving control circuit 2 generates clock signals for the A/D converter 1 and writing and reading signals for the memory 4 synchronously with the horizontal and vertical sync signals contained in the input image signals. The driving control circuit 2 also generates various types of switching signals to execute gradation driving of the PDP 10 based on the light emission driving format shown in FIG. 4, and supplies them to the address driver 6, the first sustain driver 7 and the second sustain driver 8.

The data conversion circuit 3 converts the 8-bit pixel data D to 14-bit converted pixel data (display pixel data) HD and supplies the converted pixel data HD to the memory 4.

The memory 4 sequentially writes the converted pixel data HD based on the write signals supplied from the driving control circuit 2. When writing for one screen (including m columns and n rows) through this write operation is completed, the memory 4 divides the converted pixel data $HD_{11}$–HDnm for one screen and reads it out on a bit-by-bit basis, and then supplies the read-out converted pixel data to the address driver 6 one display line at a time.

The address driver 6 generates m number of pixel data pulses (m pixel data pulses) having a voltage corresponding to the logical level of each bit of the converted pixel data for one display line read out from the memory 4, in accordance with timing signals supplied by the driving control circuit 2, and applies these pixel data pulses to the corresponding address electrodes in the PDP 10.

The first and second sustain drivers 7 and 8 generate various types of drive pulses in accordance with the timing signals supplied by the driving control circuit 2 and apply these pulses to the row electrodes $X_1$–$X_n$, and $Y_1$–$Y_n$ of the PDP 10.

The PDP 10 includes m number of address electrodes $D_1$–$D_m$ as the column electrodes and row electrodes $X_1$–$X_n$ and $Y_1$,–$Y_n$ aligned perpendicular to the column electrodes. In the PDP 10, a row electrode X and a row electrode Y together define a row electrode pair corresponding to each display line. In other words, the row electrode pair for the first display line in the PDP 10 consists of the row electrode $X_1$ and row electrode $Y_1$, and the row electrode pair for the nth display line consists of the row electrode $X_n$ and row electrode $Y_n$. The address electrodes and the row electrode pairs are each covered by a dielectric layer. Each address electrode faces a corresponding row electrode pair across a discharge space. A discharge gas such as xenon (Xe) is infused into the discharge space. A discharge cell that serves as a display pixel is formed at each of intersections of the row electrode pairs and column electrodes. In this manner, the discharge cells are arranged in a matrix fashion.

Figure 3:
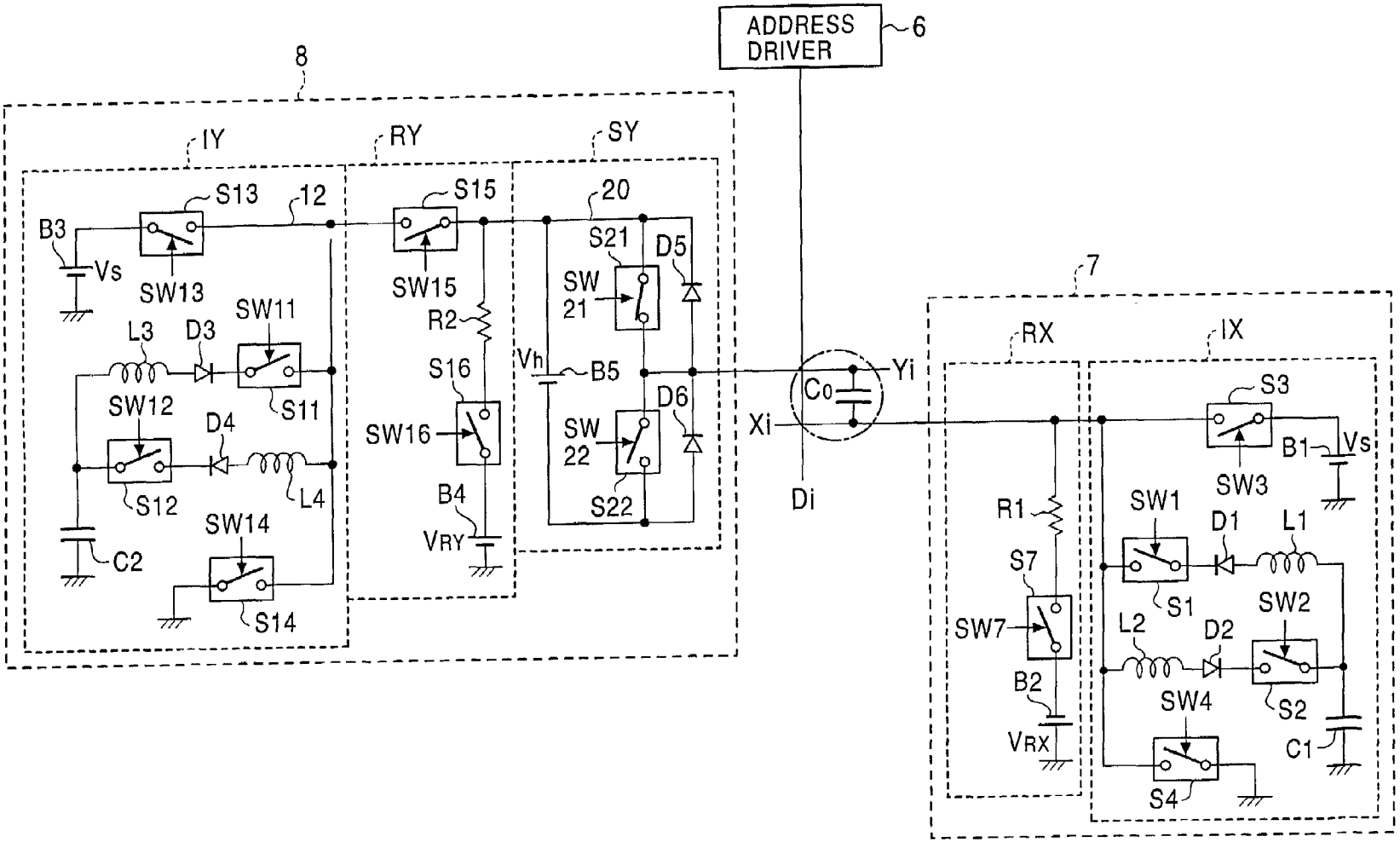
FIG. 3 shows the construction of a first sustain driver and a second sustain driver of the PDP shown in FIG. 2.

FIG. 3 shows the internal construction of the first and second sustain drivers 7 and 8. In particular, the construction of the first and second sustain drivers 7 and 8 and the construction of the discharge cell formed by the row electrode pair $X_i$ and $Y_i$ ($1 \leqq i \leqq n$) and the address electrode $D_j$ ($1 \leqq j \leqq m$) are shown in detail.

As shown in FIG. 3, the first sustain driver 7 includes a reset pulse generating circuit RX that generates reset pulses RPX and a sustaining pulse generating circuit IX that generates sustaining pulses IPX.

The sustaining pulse generating circuit IX includes a DC power supply B1 that generates a DC voltage VS, switching elements S1 to S4, coils L1 and L2, diodes D1 and D2, and a condenser (capacitor) C1. The switching element S1 enters the ON state only during the period that the switching signal SW1 supplied by the driving control circuit 4 is at the logical level '1', and applies the potential at one end of the condenser C1 to the row electrode $X_i$ via the coil L1 and the diode D1. The switching element S2 enters the ON state only during the period that the switching signal SW2 supplied by the driving control circuit 4 is at the logical level '1', and applies the potential at the row electrode $X_i$ to one end of the condenser C1 via the coil L2 and the diode D2. The switching element S3 enters the ON state only during the period that the switching signal SW3 supplied by the driving control circuit 4 is at the logical level '1', and applies the voltage VS generated by the DC power supply B1 to the row electrode $X_i$. The switching element S4 enters the ON state only during the period that the switching signal SW4 supplied by the driving control circuit 4 is at the logical level '1', and grounds the row electrode $X_i$.

The reset pulse generating circuit RX includes a DC power supply B2 that generates a DC voltage VRx, a switching element S7, and a resistor R1. The positive terminal of the DC power supply B2 is grounded, and the negative terminal of the DC power supply B2 is connected to the switching element S7. The switching element S7 enters the ON state only during the period that the switching signal SW7 supplied by the driving control circuit 4 is at the logical level '1', and applies the voltage VR, which is the negative terminal voltage of the DC power supply B2, to the row electrode $X_i$ via the resistor R1.

The second sustain driver 8 includes a reset pulse generating circuit RY that generates reset pulses RPY, a scanning pulse generating circuit SY that generates scanning pulses SP and a sustaining pulse generating circuit IY that generates sustaining pulses IPY.

The reset pulse generating circuit RY includes a DC power supply B4 that generates a DC voltage VRy ($|VRy|<|VRx|$), switching elements S15 and S16, and a resistor R2. The DC power supply B4 is designed such that the absolute value of the voltage VRy generated by the DC power supply B4 is smaller than the absolute value of the voltage VRx generated by the DC power supply B2 of the reset pulse generating circuit RX of the first sustain driver 7. The negative terminal of the DC power supply B4 is grounded, and the positive terminal is connected to the switching element S16. The switching element S16 enters the ON state only during the period that the switching signal SW16 supplied by the driving control circuit 4 is at the logical level '1', and applies the voltage Vry, which is the positive terminal voltage of the DC power supply B4, to the line 20 via the resistor R2. The switching element S15 enters the ON state only during the period that the switching signal SW15 supplied by the driving control circuit 4 is at the logical level '1', and connects the line 20 to the line 12 (will be described).

The sustaining pulse generating circuit IY includes a DC power supply B3 that generates a DV voltage VS, switching elements S11 to S14, coils L3 and L4, diodes D3 and D4, and a condenser C2. The switching element S11 enters the ON state only during the period that the switching signal SW11 supplied by the driving control circuit 4 is at the logical level '1', and applies the potential at one end of the condenser C2 to the line 12 via the coil L3 and the diode D3. The switching element S12 enters the ON state only during the period that the switching signal SW12 supplied by the driving control circuit 4 is at the logical level '1', and applies the potential at the line 12 to one end of the condenser C2 via the coil L4 and the diode D4. The switching element S13 enters the ON state only during the period that the switching signal SW13 supplied by the driving control circuit 4 is at the logical level '1', and applies the potential VS generated by the DC power supply B3 to the line 12. The switching element S14 enters the ON state only during the period that the switching signal SW14 supplied by the driving control circuit 4 is at the logical level '1', and grounds the line 12.

The scanning pulse generating circuit SY is provided for each of the row electrodes $Y_1$ to $Y_n$, and includes a DC power supply B5 generating a DC voltage Vh, switching elements S21 and S22 and diodes D5 and D6. The switching element S21 enters the ON state only during the period that the switching signal SW21 supplied by the driving control circuit 4 is at the logical level '1', and connects the positive terminal of the DC power supply B5, the row electrode Y and the cathode terminal of the diode D6. The switching element S22 enters the ON state only during the period that the switching signal SW22 supplied by the driving control circuit 4 is at the logical level '1', and connects the negative terminal of the DC power supply B5, the row electrode Y and the anode terminal of the diode D5.

The driving of the PDP 10 described above will now be described.

Figure 4:
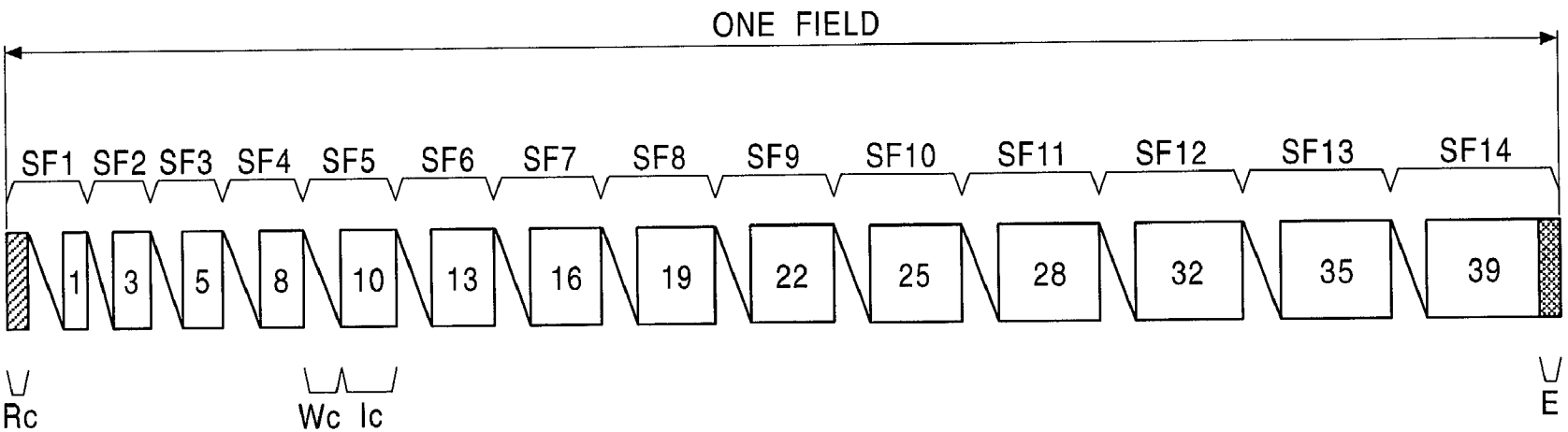
FIG. 4 shows one example of a light emission driving format.
Figure 5:
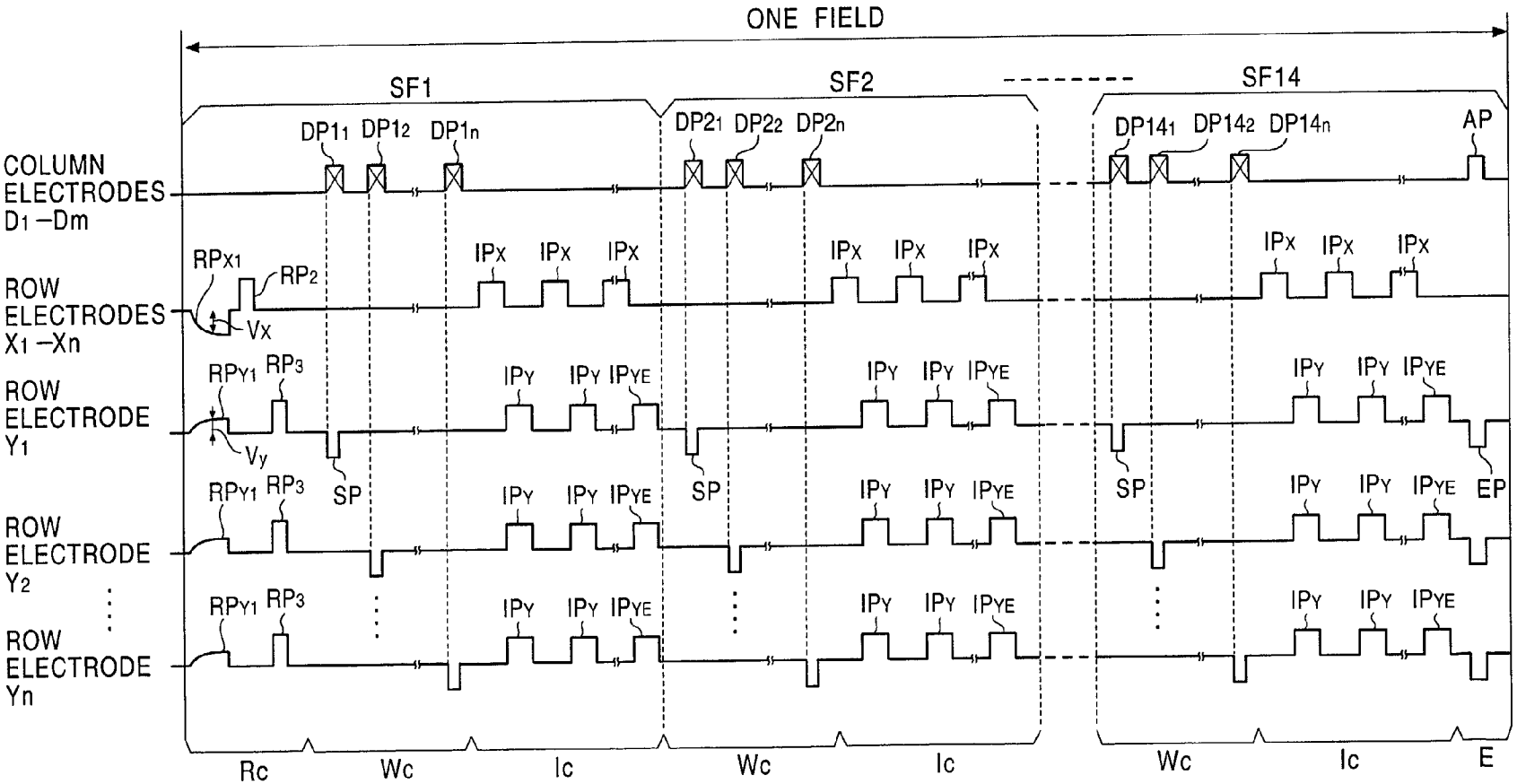
FIG. 5 shows drive pulses applied in one field, and timing at which these pulses are applied.

FIG. 4 depicts the light emission driving format used in the PDP 10. FIG. 5 depicts the timing of the application of the various drive pulses to the address electrodes $D_1$–$D_m$ and the row electrodes $X_1$–$X_n$ and $Y_1$–$Y_n$ of the PDP 10 from the address driver 6, the first sustain driver 7 and the second sustain driver 8 based on the light emission driving format shown in FIG. 4.

In the example shown in FIG. 4 and FIG. 5, the display period of one field is divided into 14 sub-fields SF1–SF14 in the driving of the PDP 10. In each sub-field are carried out a pixel data writing operation Wc in which pixel data is written to each discharge cell in the PDP 10 to set (determine) light emission or non-light-emission, and a light emission sustaining operation Ic that sustains light emission for only those discharge cells that are set for light emission in the pixel data writing operation, i.e., that are set as light emitter cells. Furthermore, the simultaneous reset operation Rc that initializes all discharge cells in the PDP 10 is carried out in the first sub-field SF1, and an erase operation E is carried out in the last sub-field SF14 of the one field.

As shown in FIG. 5, in the simultaneous reset operation Rc, the first sustain driver 7 and the second sustain driver 8 simultaneously apply the reset pulses $RP_{X1}$ and $RP_{Y1}$, respectively, to the row electrodes $X_1$–$X_n$ and $Y_1$–$Y_n$, respectively, of the PDP 10. When the difference in potential (|Vx|+|Vy|) between the row electrodes X and Y (where |Vx|<Vrx and |Vy|<Vry) exceeds the discharge start voltage (Vx–y) between these row electrodes, a discharge occurs between the pair of row electrodes in every discharge cell in the PDP 10, and a certain wall charge is uniformly formed in each discharge cell. In this way, every discharge cell in the PDP 10 becomes a light emitter cell that can emit light during the light emission sustaining operation (will be described).

In the pixel data writing operation Wc, the address driver 6 applies pixel data pulse groups $DP1_1$–$DP1_n$, $DP2_1$–$DP2_n$, $DP3_1$–$DP3_n$, . . . $DP14_1$–$DP14_n$ (pulse groups for the respective display lines) in sequence to the column electrodes $D_1$–$D_m$. In other words, in the first sub-field SF1, the address driver 6 sequentially applies the pixel data pulse groups $DP1_1$–$DP1_n$ corresponding to each of the first through nth display lines and generated based on the first bit of the converted pixel data HD11_HDnm to the column electrodes $D_1$–$D_m$ for each display line. Next, in the second sub-field SF2, the address driver 6 sequentially applies the pixel data pulse groups $DP2_1$–$DP2_n$, corresponding to each of the first through nth display lines and generated based on the second bit of the converted pixel data HD11_HDnm, to the column electrodes $D_1$–$D_m$ for each display line. When this occurs, the address driver 6 generates a high-voltage pixel data pulse and applies it to the column electrode D only when the bit logic of the converted pixel data is at the logical level of '1', for example. The second sustain driver 8 generates scanning pulses SP and sequentially applies them to the row electrodes $Y_1$–$Y_n$ at the same timing used for the application of each pixel data pulse group DP. In each discharge cell, only when a scanning pulse SP is applied to one of the row electrodes, and a high-voltage pixel data pulse is applied to the address electrode, a discharge (selective erasing discharge) occurs between one of the row electrodes and the address electrode, and the wall charge remaining in the discharge cell is erased. As a result of this selective erasing discharge, the discharge cells that are set to the light emission state in the simultaneous reset operation Rc shift to the non-light-emission state. In the discharge cells corresponding to the address electrodes to which a high-voltage pixel data pulse is not applied, a discharge does not occur, and the state that has been set in the simultaneous reset operation Rc, i.e., the light emission state, is sustained.

In other words, as a result of the pixel data writing operation Wc, the discharge cells that are maintained in a light emission state in the subsequent light emission sustaining operation, i.e., the light emitter cells, and the discharge cells that will be left unlit, i.e., the non-light-emitter cells, are selectively set in accordance with the pixel data. That is, so-called pixel data writing in the discharge cells takes place.

Scanning pulses SP are generated in each of the sub-fields SF1–SF14 in the order of the row electrodes $Y_1$–$Y_n$ (from $Y_1$ to $Y_n$). The pulse width of the scanning pulses SP is the largest in the sub-field SF1, and gradually shortens in length in the subsequent sub-fields, with the sub-field SF14 having the smallest pulse width. In other words, as shown in FIG. 4, if the pulse widths of the scanning pulses SP corresponding to the sub-fields SF1–SF14 are deemed Ta1–Ta14, the relationship Ta1>Ta2>Ta3>Ta4>. . . Ta12>Ta13>Ta14 exists.

In the light emission sustaining operation Ic, the first sustain driver 7 and the second sustain driver 8 alternately apply sustaining pulses $IP_X$ and $IP_Y$ having a pulse amplitude Vs to the row electrodes $X_1$–$X_n$ and $Y_1$–$Y_n$, respectively. During the period in which the sustaining pulses $IP_X$ and $IP_Y$ are alternately applied to the row electrodes $X_1$–$X_n$, and $Y_1$–$Y_n$, a discharge repeatedly occurs between the row electrodes of the row electrode pair in each of the discharge cells in which a wall charge remains due to the pixel data writing operation Wc, i.e., the light emitter cells, thereby sustaining the light emission state of these discharge cells. The period during which light emission is continuously sustained during the light emission sustaining operation Ic differs for each sub-field, as shown in FIG. 4.

In other words, if the light emission period during the light emission sustaining operation Ic in the sub-field SF1 is deemed '1', the light emission periods for other sub-fields are set as follows:

| | |
|---|---|
| SF1: | 1 |
| SF2: | 3 |
| SF3: | 5 |
| SF4: | 8 |
| SF5: | 10 |
| SF6: | 13 |
| SF7: | 16 |
| SF8: | 19 |
| SF9: | 22 |
| SF10: | 25 |
| SF11: | 28 |
| SF12: | 32 |
| SF13: | 35 |
| SF14: | 39 |

In this way, the ratios of the light emission iterations for the sub-fields SF1–SF14 are set to be non-linear (for example, a reverse gamma ratio, i.e., $Y=X^{2.2}$). As a result the non-linear characteristic (gamma characteristic) of the input pixel data D is corrected.

In each of the sub-fields SF1–SF14, the pulse width Tsx1 of the sustaining pulse $IP_{X1}$ first applied to the row electrodes $X_1$–$X_n$ is set to be larger than the pulse widths Tsx2–Tsxi of the subsequent sustaining pulses $IP_{X2}$–$IP_{Xi}$, respectively. The pulse width Tsyi of the final sustaining pulse $IP_{Yi}$ that is applied to the row electrodes $Y_1$–$Y_n$ is set to be larger than the pulse widths Tsy1 to Tsyi-1 of the preceding sustaining pulses $IP_{Y1}$–$IP_{Yi-1}$, respectively.

In the erasing operation E for the final sub-field SF14 of one field, the address driver 6 generates an erasing pulse AP and applies it to the column electrode $D_{1-m}$. At the same time, the second sustain driver 8 generates an erasing pulse EP and applies it to each of the row electrodes $Y_1$–$Y_n$ based on the same timing as that used for the application of the erasing pulse AP. The simultaneous application of these erasing pulses AP and EP induces an erasing discharge in every discharge cell in the PDP 10, thereby extinguishing the wall charge in every discharge cell remaining therein. In other words, through this erasing discharge, every discharge cell in the PDP 10 becomes a non-light-emitter cell.

FIG. 6 shows the overall pattern of the light emission driving carried out based on the light emission driving format shown in FIGS. 4 and 5.

As shown in FIG. 6, a selective erasing discharge is carried out in each discharge cell during the pixel data writing operation Wc in one sub-field (indicated by a black circle) among the sub-fields SF1 through SF14. In other words, the wall charge formed in every discharge cell in the PDP 10 during the simultaneous reset operation RC remains until the selective erasing discharge is carried out, and light is emitted (as indicated by the white circles) upon the discharge occurring in the light emission sustaining operation Ic in each sub-field SF that exists until the selective erasing discharge occurs. That is, each discharge cell becomes a light emitter cell until a selective erasing discharge occurs during a field period, and continues light emission in accordance with the light emission period ratios shown in FIG. 4 in the light emission sustaining operation Ic in each sub-field that exists until the selective erasing discharge.

Here, a discharge cell can shift from a light emitter cell state to a non-light emitter cell state only once during one field. In other words, a light emission drive pattern in which a discharge cell set to be a non-light emitter cell is restored as a light emitter cell during a field period is prohibited.

Therefore, because it is acceptable if the simultaneous reset operation that is not involved in image display but is accompanied by high-intensity light emission is carried out only once during a field period, a reduction in contrast can be minimized.

In addition, because the selective erasing discharge carried out during a field period occurs only once at most, the power consumption of the PDP can be limited. Furthermore, the false contour problem can be minimized.

Figure 7:
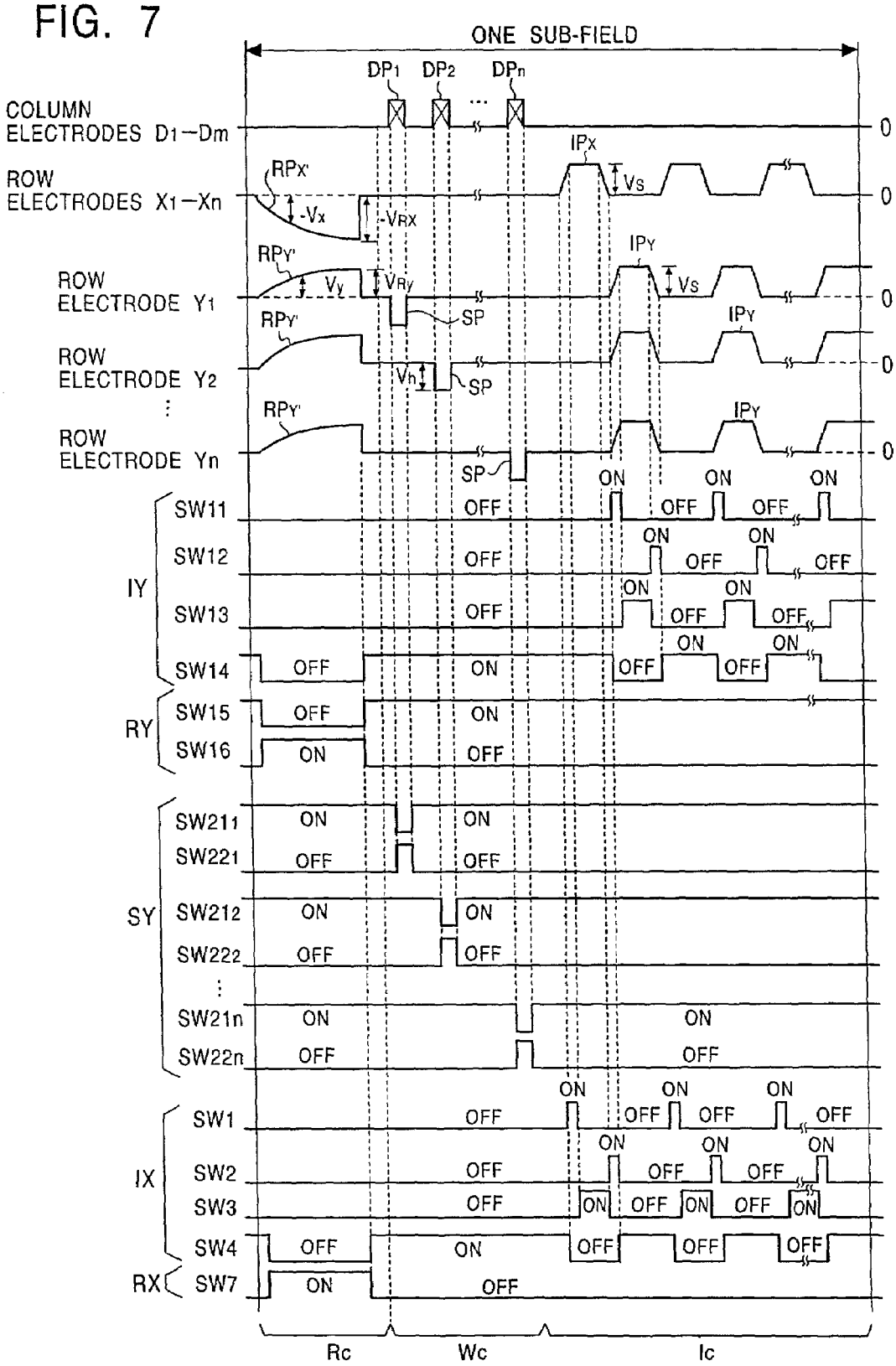
FIG. 7 illustrates a diagram showing various drive pulses generated in accordance with switching signals in a selective erasing address method, and timing at which these pulses are applied.

FIG. 7 shows the various drive pulses applied to the PDP 10 by the address driver 6, the first sustain driver 7 and the second driver 8 during the sub-field SF1 shown in FIG. 4 when the selective erasing address method is employed, as well as the timing at which such pulses are applied.

In the simultaneous reset operation Rc, the driving control circuit 4 supplies switching signals SW7 to the reset pulse generating circuit RX. In other words, first, the driving control circuit 4 continuously supplies a switching signal SW7 having a logical level of '1' to the reset pulse generating circuit RX for a prescribed period. As a result, the switching element S7 enters the ON state and the voltage VRx, which is the negative terminal voltage of the DC power supply B2, is applied to the row electrode X via the resistor R1. When this occurs, because a load capacitor C0 exists between the row electrode X and the row electrode Y, the potential in the row electrode X decreases gradually until it reaches the voltage −VRx.

Through this operation, the first sustain driver 7 applies the negative polarity reset pulse RPX' having the waveform shown in FIG. 7, i.e., the reset pulse RPX' that has a negative polarity and a gradually declining voltage, to the row electrodes $X_1$–$X_n$.

In addition, in the simultaneous reset operation Rc, the driving control circuit 4 supplies a switching signal SW21 having a logical level of '1' and a switching signal SW22 having a logical level of '0' to the scanning pulse generating circuit SY. As a result, the switching element S21 enters the ON state, and the potential in the line 20 is applied to the row electrode Y without change. Furthermore, in the simultaneous reset operation Rc, the driving control circuit 4 supplies a switching signal SW16 to the reset pulse generating circuit RY. In other words, the driving control circuit 4 first continuously supplies a switching signal SW16 having a logical level of '1' to the reset pulse generating circuit RY for a prescribed period. As a result, the switching element S16 enters the ON state, and the voltage VR including the positive terminal voltage from the DC power supply B4 is applied to the row electrode Y via the resistor R2 and the line 20. When this occurs, the potential in the row electrode Y rises gradually due to the load capacitor C0 of the row electrodes X and Y until it reaches the voltage VR.

Through this operation, the second sustain driver 8 applies a positive polarity reset pulse RPY' having the waveform shown in FIG. 7 to each of the row electrodes $Y_1$–$Y_n$ on a global basis (simultaneously) at the same time that the reset pulse RPX' is applied. In other words, the second sustain driver 8 applies to the row electrodes $Y_1$–$Y_n$ the reset pulse RPY', the voltage of which gradually increases to reach the voltage VR.

In response to the application of the reset pulses RPX' and RPY', when the difference in potential between the row electrode X and its paired electrode Y exceeds a minimum reset discharge start voltage $V_{MIN}$, a weak discharge occurs and priming particles are created inside every discharge cell of the PDP 10. When the difference in potential that exceeds the reset discharge start voltage is continuously applied for a prescribed period of time, a certain amount of wall charge is formed in the discharge cell. In other words, by applying the minimum voltage $V_{MIN}$ that can cause a reset discharge to the discharge cell, a low light intensity (luminance) discharge is triggered, and by continuously applying a voltage between the electrode pair, a certain amount of wall charge is formed in a short period of time.

As a result of the performance of the simultaneous reset operation Rc, every discharge cell of the PDP 10 is initialized to the 'light emitter cell' state in which it can emit light (sustaining discharge) during the subsequent light emission sustaining operation Ic.

Figure 8:
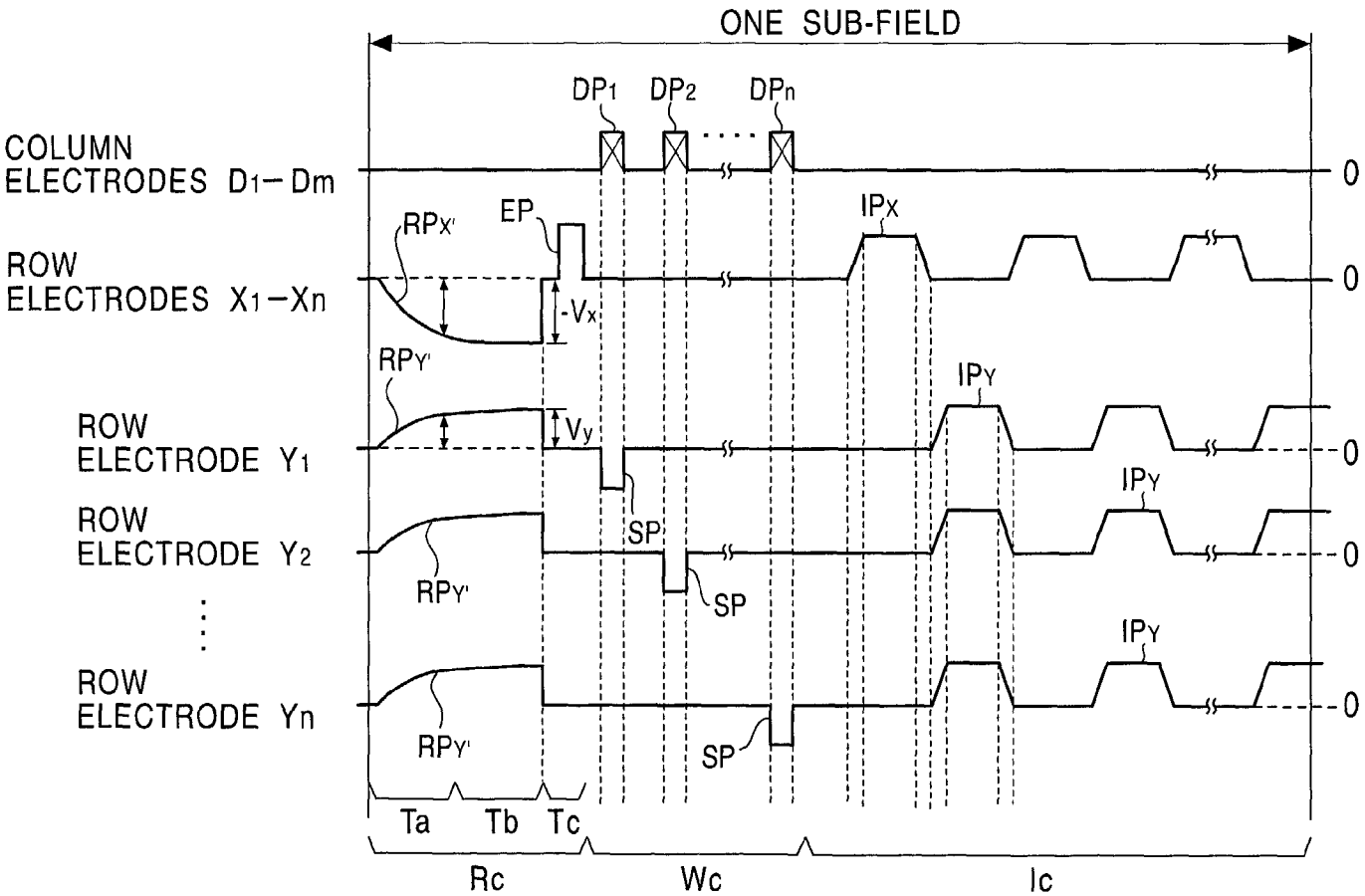
FIG. 8 illustrates various drive pulses applied in one sub-field when the PDP is driven pursuant to a selective writing address method, and timing at which these pulses are applied.

When the selective writing address method is adopted, an erasing pulse EP, which is a short pulse having a polarity opposite that of the reset pulse RPX', is simultaneously applied to all the row electrodes $X_1$–$X_n$ in the simultaneous reset operation Rc, thereby causing a discharge, as shown in FIG. 8. As a result of this discharge, the wall charge in every discharge cell is erased, and every discharge cell is initialized to the 'non-light emitter' state. Furthermore, when a negative polarity scanning pulse SP is applied in the pixel data writing operation Wc, a discharge (selective writing discharge) is triggered in only the discharge cells located at the intersections between the display lines to which the scanning pulse SP is applied and the 'columns' to which a high-voltage pixel data pulse is applied. This selective writing discharge generates a wall charge in the discharge cells, and these discharge cells are set as the 'light emitter cells' that can emit light (sustaining discharge) during the subsequent light emission sustaining operation Ic. On the other hand, the selective writing discharge is not triggered in the discharge cells to which the scanning pulse SP and a low-voltage pixel data pulse are applied, and these discharge cells are maintained in the state in which they are initialized in the previous simultaneous reset operation Rc, i.e., in the state in which there is no wall charge, and are set as 'non-light emitter cells'.

Next, in the pixel data writing operation Wc, the address driver 6 generates a pixel data pulse having a pulse voltage that corresponds to the pixel driving data bit DB supplied from the memory 4. In this sub-field SF1, the address driver 6 generates a high-voltage pixel data pulse to the pixel driving data bit when the logical level of the pixel driving data bit is '1', and generates a low voltage (zero volts) data pulse to the pixel driving data bit when the logical level of the pixel driving data bit is '0'. The address driver 6 then sequentially applies to the column electrodes $D_1$–$D_m$ the pixel data pulse groups $DP_1$–$DP_n$, each of which pulse groups includes pixel data pulses grouped for each display line.

In the meantime, synchronously with the application of the respective pixel data pulse groups $DP_1$–$DP_n$, the driving control circuit 4 sequentially supplies a switching signal SW21 having a logical level of '0' and a switching signal SW22 having a logical level of '1' to the scanning pulse generating circuit SY for the corresponding row electrode.

In the scanning pulse generating circuit SY to which the switching signals SW21 and SW22 are supplied, the switching element S22 enters the ON state and the switching element S21 enters the OFF state. As a result, a negative polarity scanning pulse SP having a voltage of −Vh is applied to the column electrode Y. When this occurs, a discharge (selective erasing discharge) is triggered in only the discharge cells located at the intersections between the display lines to which the scanning pulse SP is applied and the 'address electrodes' to which a high-voltage pixel data pulse is applied. As a result of this selective erasing discharge, the wall charge maintained in the discharge cells is erased, and these discharge cells are shifted to the 'non-light emitter cell' state in which they do not emit light (sustaining discharge) during the light emission sustaining operation Ic described below. On the other hand, the selective erasing discharge is not triggered in the discharge cells to which the scanning pulse SP and a low-voltage pixel data pulse are applied, and these discharge cells are maintained in the state in which they are initialized in the previous simultaneous reset operation Rc, i.e., in the 'light emitter cell' state.

When the selective writing address method is adopted, and a negative polarity scanning pulse SP is applied in the pixel data writing operation Wc, a discharge (selective writing discharge) is triggered in only the discharge cells located at the intersections between the display lines to which the scanning pulse SP is applied and the 'columns' to which a high-voltage pixel data pulse is applied. As a result of this selective writing discharge, a wall charge is generated in the discharge cells, and these discharge cells are set as 'light emitter cells' that can emit light (sustaining discharge) during the subsequent light emission sustaining operation Ic. On the other hand, the selective writing discharge is not triggered in the discharge cells for which the scanning pulse SP and a low-voltage pixel data pulse are applied, and these discharge cells are maintained in the state in which they are initialized in the previous simultaneous reset operation Rc, i.e., in the no wall charge state, and are set as 'non-light emitter cells'.

In other words, in each of the selective erasing address method and the selective writing address method, the pixel data writing operation Wc causes each discharge cell in the PDP 10 to become either the 'light emitter cell' state or the 'non-light emitter cell' state in accordance with the pixel data derived from the input image signals.

Next, in the light emission sustaining operation Ic, the driving control circuit 4 supplies switching signals SW1–SW4 that change as shown in FIG. 7 to the sustaining pulse generating circuit IX. These switching signals SW1–SW4, first, bring the switching element S1 only into the ON state, and the current that accompanies the charge accumulated in the condenser C1 travels to the discharge cell via the coil L1, the diode D1 and the row electrode X. As a result, the voltage in the row electrode X increases gradually. Then, the switching element S3 only enters the ON state, and the voltage VS generated by the DC power supply B1 is directly applied to the row electrode X. As a result, the voltage in the row electrode X becomes the voltage VS. Next, the switching element S2 only enters the ON state, and the current that accompanies the charge accumulated in the load capacitor C0 between the row electrode X and the row electrode Y travels to the condenser C1 via the coil L2 and the diode D2. As a result, the voltage in the row electrode X declines. When this operation is repeated, the sustaining pulse generating circuit IX repeatedly applies a sustaining pulse IPX to the row electrode X.

In the light emission sustaining operation Ic, the driving control circuit 4 supplies switching signals SW11–SW14 to the sustaining pulse generating circuit IY. These switching signals SW11–SW14, first, bring the switching element S11 only to the ON state, and the current that accompanies the charge accumulated in the condenser C2 travels to the discharge cell via the coil L3, the diode D3, the line 12, the switching element S15, the line 20, the switching element S21, and the row electrode Y. As a result, the voltage in the row electrode Y increases. Next, the switching element S13 only enters the ON state, and the voltage VS generated by the DC power supply B3 is applied to the row electrode Y via the line 12, the switching element S15, the line 20 and the switching element S21. As a result, the voltage in the row electrode Y becomes the voltage VS. Next, the switching element S12 only enters the ON state, and the current that accompanies the charge accumulated in the load capacitor C0 between the row electrode X and the row electrode Y travels to the condenser C2 via the row electrode Y, the switching element S21, the line 20, the switching element S15, the coil L4 and the diode D4. As a result, the voltage in the row electrode Y declines. As this operation is repeated, the sustaining pulse generating circuit IY repeatedly applies a sustaining pulse IPY to the row electrode Y.

In other words, in the light emission sustaining operation Ic, the first sustain driver 7 and the second sustain driver 8 repeatedly impress the positive polarity sustaining pulse IPX and the positive polarity sustaining pulse IPY to the row electrodes $X_1$–$X_n$ and the row electrodes $Y_1$–$Y_n$ in an alternating fashion. When this is done, a discharge (sustaining discharge) is repeatedly triggered in only the discharge cells in which a wall charge exists, i.e., in only the discharge cells in the 'light emitter cell' state, each time the sustaining pulses IPX and IPY are impressed, and the light emission that accompanies this discharge repeatedly occurs in these discharge cells.

As described above, light emission repeatedly occurs in the light emission sustaining operation Ic, and a display image is accordingly formed, in only those discharge cells in which the wall charge formed upon the reset discharge in the simultaneous reset operation Rc remains without being erased in the pixel data writing operation Wc.

Next, the state of the charge existing in the discharge cells during light emission driving of the PDP and the state of the discharge triggered during each operation will be described in detail below.

In general, in both the pixel data writing operation and the erasing operation, the PDP is driven such that a discharge is triggered between the address electrodes and the row electrodes to set the discharge cells to either the light emission or non-light emission state or to nullify these settings. However, because discharge during the simultaneous reset operation triggers light emission in discharge cells that have nothing to do with display, a certain approach is desired to be taken to reduce the light intensity of the emission due to the discharge between the electrodes.

Figure 9:
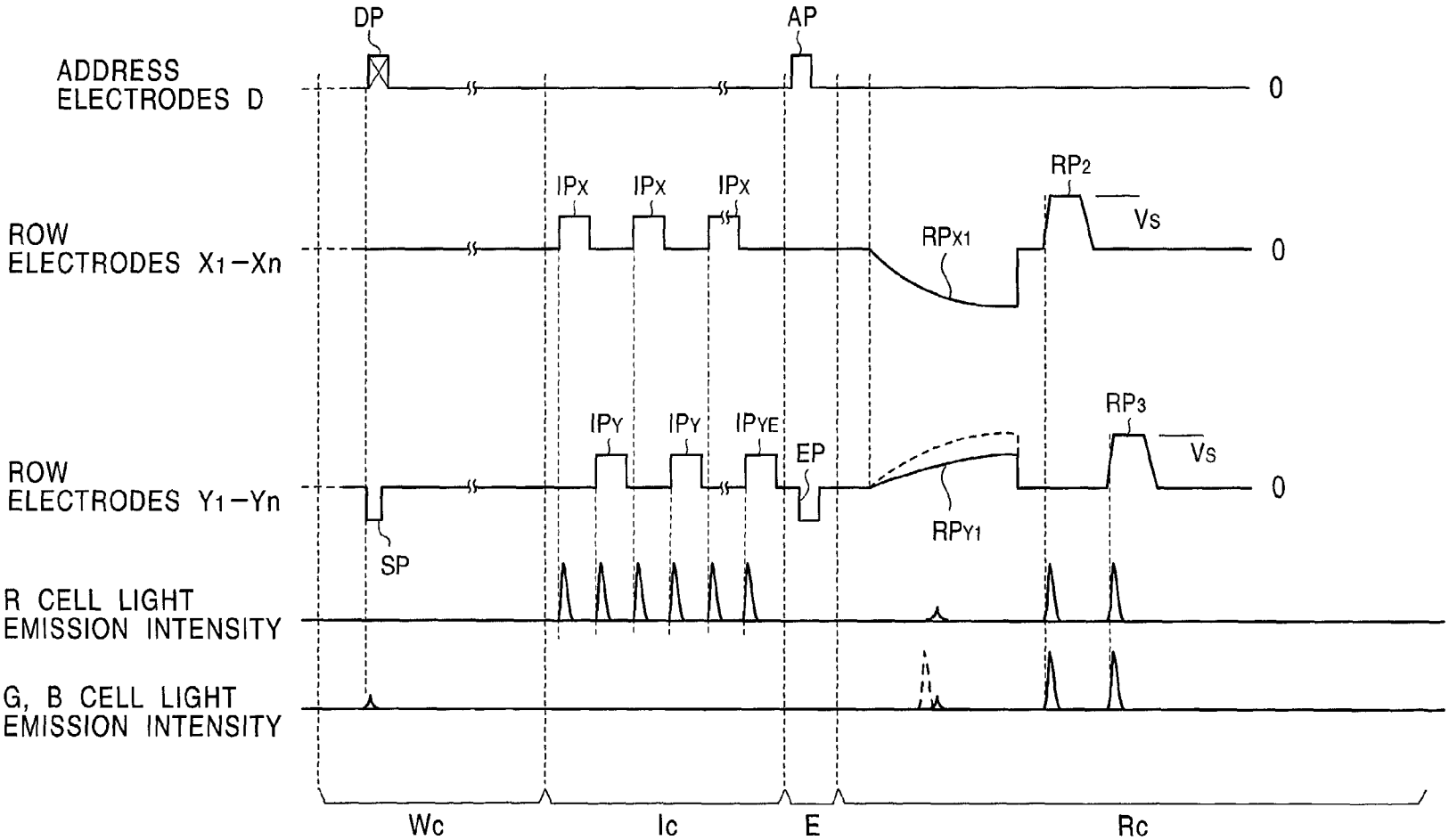
FIG. 9 illustrates the relationship between the drive pulses applied to electrodes and light intensities of the discharge cells.

For example, let us focus on one pixel and consider a situation in which red light is to be emitted from that pixel. FIG. 9 shows the pulses applied to each of the R (red), G (green) and B (blue) discharge cells (hereinafter referred to as R, G and B cells respectively), which constitute the pixel concerned, and the state of light emission of each discharge cell when the pixel emits red light. Here, the potentials at the address electrode, the row electrode X and the row electrode Y are deemed to be Vx, Vy and VA, respectively.

Figure 10A:
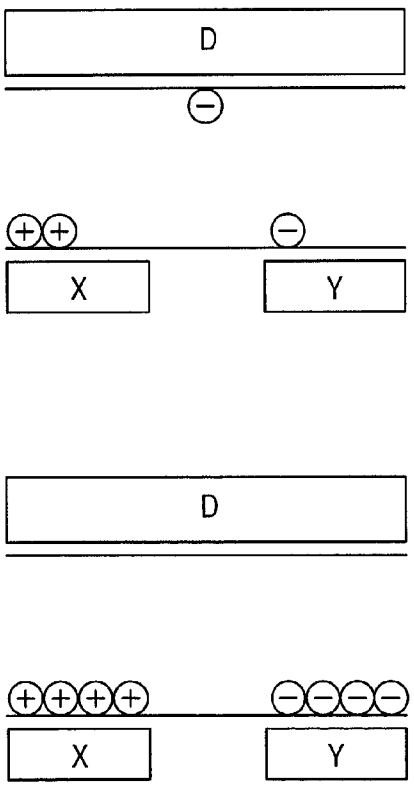
FIGS. 10A and 10B illustrate the state of the wall charge in each discharge cell respectively; specifically.

As illustrated in FIG. 9, because only the R cell is set to emit light, only the wall charge in the R cell is allowed to remain after the application of the pixel data pulse group DP and the scanning pulse SP in the pixel data writing operation Wc, while a discharge to erase the wall charge is triggered between the address and row electrodes in the G and B cells. Therefore, the state of the wall charge in the R, G and B cells immediately after the setting of the light emitter or non-light emitter state is presumed to match the representation shown in FIG. 10A. In other words, because a substantial amount of wall charge remains in the row electrodes of the R cell, the differences in potential |Vx−VA| and |Vy−VA| between the row electrodes X and Y and the address electrode of the R cell are significant. On the other hand, the differences in potential |Vx−VA| and |Vy−VA| between the row electrodes X and Y and the address electrode of the G and B cells become small because the wall discharge extinguishes in the row electrodes in the G and B cells.

Figure 10B:
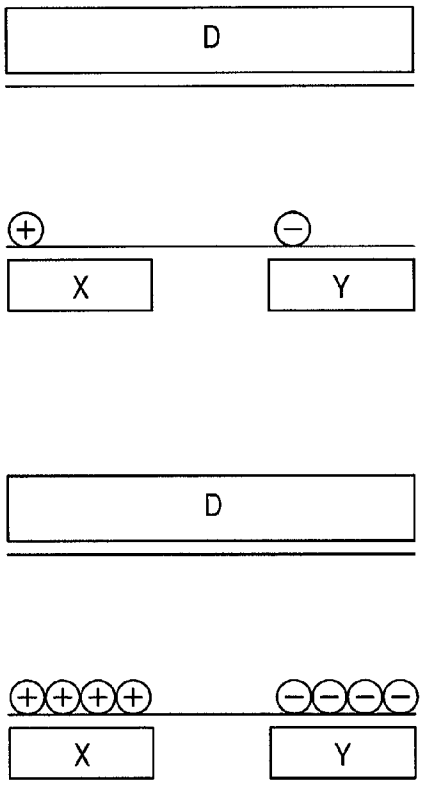

In the next light emission sustaining operation, as the sustaining pulses IPx and Ipy are applied, a discharge is repeatedly triggered in the R cell and the emission of red light from the R cell is sustained. Because discharge occurs in the R cell every time the sustaining pulses IPx and IPy are applied, a wall charge is generated and remains in both the X and Y row electrodes every time the discharge occurs. Therefore, both the X and Y row electrodes in (all) the discharge cells that emit light in the light emission sustaining operation have a substantial amount of wall charge. On the other hand, in the G and B cells that are set as non-light emitter cells, because the wall charge is small, no discharge is triggered by the application of the sustaining pulses, and therefore a new wall charge is not formed as a result of the discharge. Therefore, it is believed that the wall charge in the R, G and B cells immediately after the completion of the sustain discharge can be depicted as in FIG. 10B.

In other words, in the light emitter cells, because the differences in potential |Vx−VA| and |Vy−VA| are large, the discharge start voltage Va–c between the address and row electrodes becomes high. On the other hand, in the non-light emitter cells, because no wall charge is supplied via discharge, and because the small amount of remaining wall charge only decreases, the differences in potential |Vx−VA| and |Vy−VA| between the row electrodes X and Y and the address electrode of the G and B cells become small. Therefore, in the G and B cells that are set as non-light emitter cells, even if a relatively low-voltage pulse is applied, a strong discharge occurs between the address and row electrodes more easily than it occurs in the R cell.

In the erasing operation after the sustaining light emission operation, a positive erasing pulse AP and a negative erasing pulse EP are applied to the address electrode and the row electrode Y, respectively. As a result, a small mount of positive (+) wall charge remains in the row electrode Y, while a small amount of negative (−) wall charge remains in the row electrode X and the address electrode in the non-light emitter G and B cells, so that a discharge occurs more easily between the address electrode and the row electrode Y than in the R cell.

Next, the simultaneous reset operation is performed for the next field for all R, G and B cells, and reset pulses $RP_{X1}$ and $RP_{Y1}$ are simultaneously applied to the row electrodes of the R, G and B cells. When this is done, even if the discharge start voltage between the address electrode and the row electrodes is considerably low in the G and B cells, the occurrence of a strong discharge between the address electrode and the row electrode Y can be prevented because the voltage level of the reset pulse RPy is smaller than the voltage level of the reset pulse RPx. Therefore, light emission, during the simultaneous reset operation immediately following the emission of red light, of green and/or blue light, which are so-called complementary colors of red light, can be suppressed. This prevents the display of a relatively high-luminous intensity ghost image of a complementary color. In FIG. 9, the reset pulse PRy1 and light intensity indicated by the solid lines show a situation in which a pulse having the same amplitude as but the opposite polarity from the reset pulse PRx1 is applied to the row electrode Y. The dashed line represents a discharge light intensity of a comparison example. Accordingly, it can be seen that the present invention can reduce the light intensity of the reset discharge.

It is revealed that when the voltage level of the reset pulse RPy is set to zero, and the voltage level of the reset pulse RPx only is set to a high level, a strong discharge is triggered between the address electrode and the row electrode X. Therefore, it is preferred that the voltage levels of the reset pulse RPx and the reset pulse RPy have a ratio Vx:Vy of approximately 2:1, for example.

Figure 11:
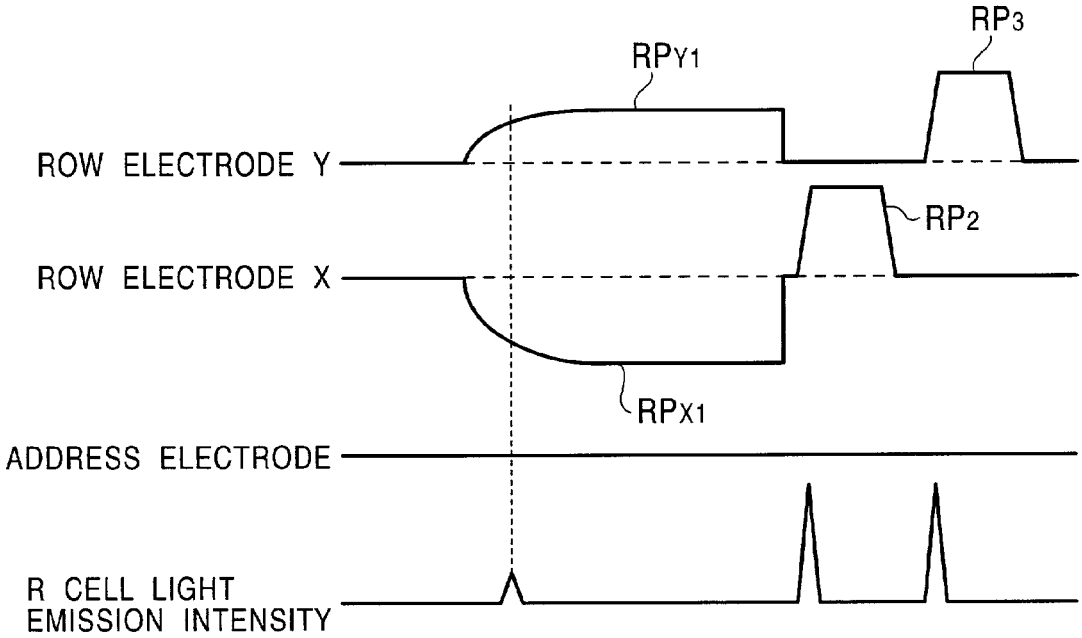
FIG. 11 illustrates the relationship between a plurality of reset pulses and the light intensity of the discharge resulting from the application of such pulses when the reset pulses are applied in the simultaneous reset operation.

In the simultaneous reset operation, for example, if a plurality of reset pulses are applied to the row electrodes, as shown in FIG. 11, and a strong discharge is triggered by the first reset pulse, a positive (+) wall charge accumulates in the address electrode D and a negative (−) wall charge accumulates in the row electrode Y, thereby triggering a strong discharge upon the application of the second and third reset pulses RP2 and RP3 and causing the discharge cell to emit light. In this invention, however, this situation can also be prevented.

Figure 12:
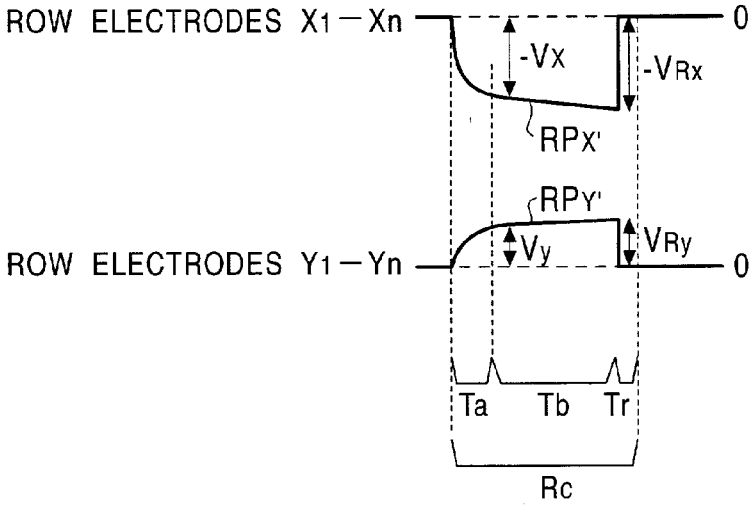
FIG. 12 illustrates reset pulses when a voltage shift of each reset pulse occurs in two stages during the simultaneous reset operation.

It should be noted that the reset pulses RPx and Rpy having the waveforms shown in FIG. 12 may be generated and applied to the row electrodes of the discharge cells. The pulse width of these reset pulses may be divided into two periods, i.e., a first pulse voltage shift period Ta and a second pulse voltage shift period Tb. In the first pulse voltage shift period Ta, the pulse has a rising waveform with a relatively small time constant in the initial part; the potential in the row electrode X falls rapidly, and the potential in the row electrode Y rises rapidly. In the second pulse voltage shift period Tb, the reset pulse changes to a pulse having a waveform with a relatively large time constant, so that the potential in the row electrode Y increases gradually and the potential in the row electrode X falls gradually. Although the voltage shifts in two stages in the reset pulses RPx and RPy in this way, the voltage level Vy of the reset pulse RPy is set to be smaller than the voltage level Vx of the reset pulse RPx at all times in the embodiment shown in FIG. 12 as well.

This application is based on Japanese Patent Application No. 2001-186461, the entire disclosure of which is incorporated herein by reference.

What is claimed is:

1. A method of driving a plasma display panel in accordance with image signals, the plasma display panel including a plurality of row electrode pairs, each of which pairs defines a display line, and a plurality of column electrodes arranged in a perpendicular fashion to the row electrode pairs such that a plurality of discharge cells, which function as display pixels, are formed at respective intersections between the column electrodes and row electrode pairs, with a display period for one field being divided into a plurality of sub-fields, wherein each sub-field is driven by a pixel data writing operation that applies a scanning pulse to one row electrode of each row electrode pair and applies a pixel data pulse corresponding to the image signal to each column electrode to generate a selecting discharge that sets every discharge cell to either a light emission state or a non-light emission state, and a light emission sustaining operation that applies sustaining pulses to the row electrode pair of every discharge cell to trigger a sustaining discharge in only those discharge cells which are set to the light emission state, so as to cause these discharge cells to repeatedly emit light, wherein either a plurality of sub-fields or each sub-field is also driven by a reset operation that, prior to the pixel data writing operation, applies reset pulses to the plurality of row electrode pairs to trigger a reset discharge in the discharge cells, and wherein the reset pulses include a first reset pulse applied to the one row electrode of each row electrode pair and a second reset pulse applied to the other row electrode of each row electrode pair at the same time as the first reset pulse is applied, and the second reset pulse has a polarity opposite that of the first reset pulse, wherein the voltage value of said first reset pulse is smaller than the voltage value of said second reset pulse.

2. The method of driving a plasma display panel according to claim 1, wherein the voltage value of the first reset pulse is ½ the voltage value of the second reset pulse.

3. The method of driving a plasma display panel according to claim 1, wherein the reset operation is performed in a leading sub-field of said one field.

* * * * *